US007286104B2

(12) United States Patent
Sempel et al.

(10) Patent No.: US 7,286,104 B2
(45) Date of Patent: Oct. 23, 2007

(54) METHOD AND DEVICE FOR GAMMA CORRECTION

(75) Inventors: Adrianus Sempel, Eindhoven (NL); Pieter Jacob Snijder, Eindhoven (NL); Remco Los, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 560 days.

(21) Appl. No.: 10/484,659

(22) PCT Filed: Jul. 31, 2002

(86) PCT No.: PCT/IB02/03222

§ 371 (c)(1),
(2), (4) Date: Jan. 23, 2004

(87) PCT Pub. No.: WO03/012771

PCT Pub. Date: Feb. 13, 2003

(65) Prior Publication Data

US 2004/0174388 A1 Sep. 9, 2004

(30) Foreign Application Priority Data

Aug. 1, 2001 (EP) ..... 01202918

(51) Int. Cl.
*G09G 3/30* (2006.01)

(52) U.S. Cl. ..... 345/77; 345/89

(58) Field of Classification Search ..... 345/76–79, 345/87–90, 92–100, 204–205, 208–214; 315/169.3

See application file for complete search history.

(56) References Cited

U.S. PATENT DOCUMENTS

| | | | | |
|---|---|---|---|---|
| 5,861,869 | A * | 1/1999 | Scheffer et al. | 345/691 |
| 6,137,542 | A | 10/2000 | Van Mourik | 348/674 |
| 6,225,931 | B1 | 5/2001 | Rao et al. | 341/144 |
| 6,781,565 | B2 * | 8/2004 | Ozawa | 345/84 |
| 7,110,010 | B1 * | 9/2006 | Masuji et al. | 345/692 |
| 2002/0126106 | A1 * | 9/2002 | Naito | 345/204 |
| 2003/0052904 | A1 * | 3/2003 | Gu | 345/691 |

FOREIGN PATENT DOCUMENTS

EP 0457440 11/1991

* cited by examiner

*Primary Examiner*—Richard Hjerpe
*Assistant Examiner*—Mansour M. Said

(57) ABSTRACT

A display device, such as an electroluminescent display device, includes a matrix of pixels, each pixel being driven by a drive pulse that is pulse width modulated. The width of the drive pulse is controlled by a gamma correction device, in which gamma correction information is supplied in the form of a separate pulse distribution-modulated signal.

9 Claims, 2 Drawing Sheets

| GSL | BD |
|---|---|
| 0 | 0000 |
| 1 | 0001 |
| 2 | 0010 |
| 3 | 0011 |
| 4 | 0100 |
| 5 | 0101 |
| 6 | 0110 |
| 7 | 0111 |
| 8 | 1000 |
| 9 | 1001 |
| 10 | 1010 |
| 11 | 1011 |
| 12 | 1100 |
| 13 | 1101 |
| 14 | 1110 |
| 15 | 1111 |

| GLREGO | CNT2 | GREYLC | SRFF |
|---|---|---|---|
| 0100 | 0000 | 1 | 1 |
| | 0001 | 1 | 1 |
| | 0010 | 1 | 1 |
| | 0011 | 1 | 1 |
| | 0100 | 0 | 0 |
| | 0101 | 1 | 0 |
| | ⋮ | | |

METHOD AND DEVICE FOR GAMMA CORRECTION

The present invention relates to a method of gamma correction for use in a display device comprising a matrix of pixels, each pixel being driven by a drive pulse, which is pulse width modulated.

The invention also relates to a display device, preferably an electroluminescent display device, comprising a matrix of display pixels, each pixel being driven by a drive pulse, which is pulse width modulated.

Displays of the above-described kind are known, for example from patent application EP-0 457 440.

There are several different types of displays on the market today, and even though other display technologies, such as those described above are rapidly increasing, a very common display device is still the cathode ray tube (CRT). However, the perception of gradual light intensity (i.e. grey scales) in CRT displays is not linearly proportional to the amount of light emanating from the display. Consequently, in existing CRT displays, this effect is taken into account, and since these types of displays having a non-linear luminance output/electrical input function are still very common, most video signal sources assume that they will be displayed on such a display. Therefore, the signals have a so-called gamma pre-correction.

However, in some recently developed display technologies, such as polymer light-emitting diode (PLED) displays or organic light-emitting diode (OLED) displays, both being of the kind described in the introduction, the relationship between applied current and emitted light is approximately linear. Extra measures are needed in order to include gamma-corrected performance, i.e. to correct the above-mentioned gamma pre-correction before the signal is displayed. If this is not taken into account, the displayed picture will have a softer appearance. Consequently, there is a need to optimally adapt the display to the human eye sensitivity curve.

In accordance with the prior art regarding gamma correction, as described in U.S. Pat. No. 6,137,542, gamma correction may be implemented by using a memory circuit, included on a drive electronics chip. In this memory, a gamma look-up table may be stored, which may be used to store values for each color luminance, which values are corrected with respect to the gamma function form. Consequently, an input signal may be converted to a gamma-corrected input signal by utilizing information stored in the memory. However, a problem with the prior art is that the above-described memory needs to be quite large, and therefore occupies a large area of the chip. Furthermore, this solution requires a high data rate for updating the memory each line, which severely loads the communication in the communication buses and also increases the power dissipation.

It is an object of the present invention to provide a method and a display device for gamma correction, avoiding the above-mentioned problems with the prior art.

The invention is defined by the independent claims. The dependent claims define advantageous embodiments.

These and other objects are achieved by a method as described in the opening paragraph, the method further comprising the steps of generating a pulse distribution-modulated signal, in which the pulse distribution is dependent on pre-determined gamma correction information, deriving an actual grey level information about each pixel from an input signal, and comparing said grey level information with a counter information based on the pulse distribution-modulated signal, in order to obtain a gamma-corrected specific width of the drive pulse. In doing so, the gamma information is provided as a separate signal, which is compared with the value of the desired grey level, in order to provide a drive pulse of a desired width. Since the gamma information is separated and further supplied as a pulse distribution-modulated signal, this information may be loaded more or less permanently into a gamma correction circuit, thereby avoiding rapid updates and heavy bus communication.

Furthermore, the method may also comprises the steps of inputting the pulse distribution-modulated signal to a pulse counter, and inputting the actual grey level information to a grey level register, the grey level register and the pulse counter having the same bit size and being connected to a comparator, the output of the comparator being coupled to a switch for controlling the drive pulse to the pixel. In doing so, a pulse width-modulated signal comprising, for example, a great plurality of bits, may be represented by a counter value having fewer bits, whereby the timing of the pulses in the pulse width-modulated signal is transferred to the changes of the counter value. Drive pulses with different durations may thereby easily be achieved, with a timing having a greater resolution than the comparator generating the drive pulse. Compared to prior-art solutions, the inventive method provides a reduction of memory and component sizes.

Furthermore, the step of generating a pulse distribution-modulated signal preferably comprises the steps of storing, in a plurality of gamma registers, timing distribution information values for the pulse distribution-modulated signal, each gamma register being connected to a first input of a respective one of a plurality of gamma level comparators, inputting, into a second input of each gamma level comparator, a counter value from a clock counter, outputting a signal pulse from any one of the gamma level comparators, when the value stored in the respective one of the gamma registers equals the inputted clock counter value, combining, in an OR-component, the outputted signal pulses to a pulse distribution-modulated signal. This is an easy way of generating the inventive pulse distribution-modulated signal, requiring a comparatively small memory area on a chip. Furthermore, the gamma registers only need to be loaded with gamma correction information once, because these are constant throughout the drive of the display device.

In accordance with a preferred embodiment of the invention, the clock counter and each gamma register comprise a larger number of bits than the pulse counter or the grey level comparator. A suitable configuration for e.g. cellular telephone display application is N=16 grey levels. The gamma registers could in this embodiment, for example, comprise 8 bits, while the pulse counter and the grey level comparator could comprise 4 bits corresponding to the 2u=16 grey levels.

The display is suitably a polymer light-emitting diode display or an organic light-emitting diode display, and the method is preferably implemented in a fully digital gamma correction device, thereby being insensitive to production spreads. Furthermore, at least one of the registers is programmable, resulting in a flexible solution.

The objects of the invention are also achieved by a display device as defined in claim 5. A width of said drive pulse is controlled by a gamma correction device using a separate pulse distribution-modulated signal (PDM), which is dependent on predetermined using gamma correction information. Since the gamma information is separated and provided as a pulse distribution-modulated signal, this information may be loaded more or less permanently into a gamma correction circuit, thereby avoiding rapid updates and heavy bus communication.

The gamma correction device also comprises a first and a second block, wherein the first block 1 comprises means for generating the pulse distribution-modulated signal, and the second block 2 comprises means for generating the drive pulse, the pulse distribution-modulated signal being arranged to be inputted to the second block from the first block. By dividing the gamma correction device into two separate parts, it is possible to pre-load gamma information into the first block, and thereafter this information may be unchanged, reducing the need for fast processing and large memory areas.

The first block may suitably comprise a plurality of gamma registers, in which timing distribution information values for the gamma correction pulse distribution-modulated signal are storable, each register being connected to a first input of a respective one of a plurality of gamma level comparators, a counter value from a clock counter being arranged to be inputted into a second input of each gamma level comparator, whereby a signal pulse from any one of said gamma level comparators is arranged to be outputted when the value stored in the respective one of said gamma registers equals the inputted clock counter value, whereafter the outputted signal pulses are inputted to an OR-component, in which they are combined to said pulse distribution-modulated signal being the output of said first block. This is an easy way of generating the inventive pulse distribution-modulated signal requiring a comparatively small memory area on a chip. Furthermore, the gamma registers only need to be loaded with gamma correction information once, because these are constant throughout the drive of the display device. This makes it possible to use a single common first block for all pixels or columns of a display.

The second block may suitably comprise a pulse counter, into which the gamma correction pulse distribution-modulated signal from the first block is arranged to be inputted, a grey level register, into which a grey level to be displayed is inputted, and a comparator, into which the outputs of the pulse counter and the grey level register are inputted, wherein the grey level register and the pulse counter have the same bit size, and the output of the comparator is coupled (directly or via a set/reset flip-flop) to a switch for controlling the power distribution to said pixel. In doing so, a pulse width-modulated signal comprising, for example, a great plurality of bits may be represented by a counter value having fewer bits, whereby the timing of the pulses in the pulse width-modulated signal is transferred to the changes of the counter value. Drive pulses with different durations may thereby easily be achieved, with a timing having a greater resolution than the comparator generating the drive pulse. Compared to prior-art solutions, the inventive method provides a reduction of memory and component sizes.

Finally, the display is preferably a polymer light-emitting diode display or an organic light-emitting diode display, and the gamma correction device is fully digital in order to achieve a system which is insensitive to production spreads. Preferably, at least one of the registers is programmable, resulting in a flexible solution.

These and other aspects of the invention will be apparent from and elucidated with reference to the accompanying drawings, in which.

The invention relates to a gamma correction circuit for a monotonic display device, such as a PLED or an OLED display. A PLED display, for example, comprises a plurality of column electrodes $C_0$, $C_1$ . . . $C_N$, and row electrodes together forming the entire display area. Each crossing of a row and a column electrode defines a pixel of the display. An electroluminescent material, here a light-emitting polymer, is arranged between the rows and columns.

Figure 1:
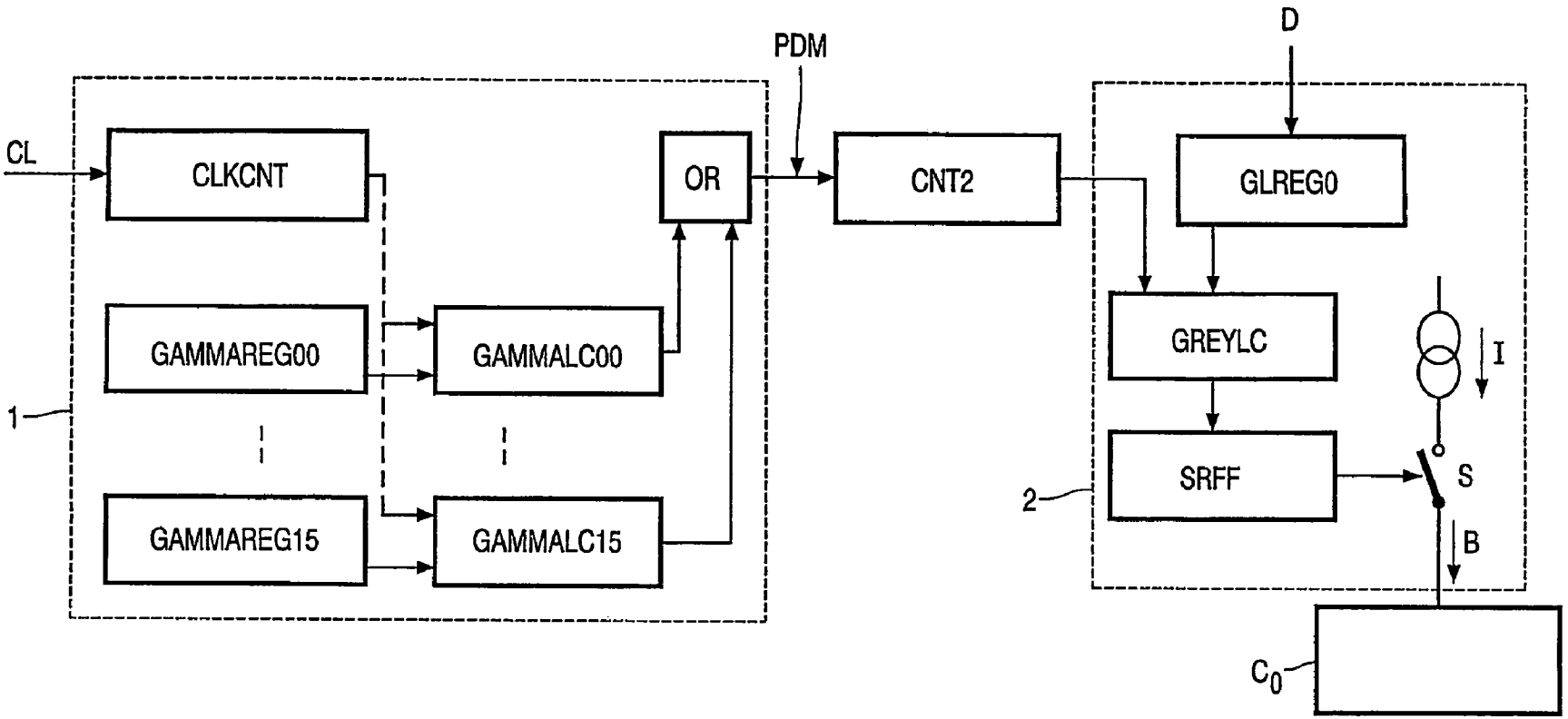
FIG. 1 is block diagram of a gamma correction circuit for use in an inventive display device, implementing the inventive method.

However, in FIG. 1 only one column, $C_0$, is indicated. The circuit, as described above, is identical for all columns of the display.

Each column is connected in series with a current source I for driving the column, and the connection is provided with a switch S for switching between a closed position, in which current is allowed to flow through the column Co and an open position, in which the current supply to the column Co is interrupted. In the closed position of the switch S, a current flows through the layer of light-emitting polymer material, whereby light is emitted from the light-emitting polymer material. In the open position of the switch S, no light is emitted from that column Co or pixel.

In accordance with the invention, the switch S is connected to a gamma correction device.

A first embodiment of the gamma correction device in accordance with the invention is schematically shown in FIG. 1. This embodiment may be utilized, for example, in mobile applications, having a sixteen-level (i.e. 4-bit) grey scale and a quadratic gamma correction. This implementation comprises a first and a second block 1 and 2, respectively, wherein the first block 1 is a correction storage block and the second block 2 is a grey level comparison block. A separate second block 2 is needed for each column $C_0$, $C_1$ . . . $C_N$ of the display, while the first block 1 may be common for all columns or for a group of columns. In this example, one common first block 1 is used for all columns. Consequently, a drive chip for the display may be manufactured, having a single first block 1 and N+1 second blocks 2, where N+1 is the total number of columns of the display device.

In the example shown, the first correction storage block 1 comprises sixteen gamma correction storage registers GAMMAREG00-GAMMAREG15; each of these registers being an 8-bit register. These registers are loadable with desired gamma correction information and need to be loaded only once. The output of each register GAMMAREG00-GAMMAREG15 is connected to an input of a respective one of sixteen gamma level comparators GAMMALC00-GAMMALC15. A second input of the gamma level comparators GAMMALC00-GAMMALC15 is connected to the output of an 8-bit clock counter CLKCNT. This clock counter CLKCNT is clocked by clock pulses CL, where every line period in this case comprises 256 clock pulses. By comparing the clock counter value with each value stored in the sixteen gamma correction storage registers GAMMAREG00-GAMMAREG15 in block 1, each gamma level comparator GAMMALC00-GAMMALC15 outputs a pulse, when the clock counter value equals the value stored in the registers connected to that comparator GAMMALC00-

GAMMALC15. Consequently, during a full line time, a total of sixteen pulses is generated by the gamma level comparators GAMMALC00-GAMMALC15, and the timing and distribution of these pulses over the line time is determined by the exact values stored in the gamma correction storage registers GAMMAREG00-GAMMAREG15. A first pulse is generated from a first gamma level comparator at an instant $t_0$, the next at an instant $t_1$ and so forth.

All of the outputs of said gamma level comparators GAMMALC00-GAMMALC15 are connected to an OR-gate OR combining the generated pulses and resulting in an output signal from the OR-gate OR, which is a special control signal PDM having a modulated pulse distribution and a reduced average frequency (here 16×) in relation to the original clock signal CL. In the construction described above, gamma correction information, as represented by the pre-set gamma correction storage registers GAMMAREG00-GAMMAREG15 has been translated into a timed signal comprising 16 pulses (one for each register), having a full 8-bit timing resolution which is due to the timing distribution.

The pulse distribution-modulated control signal (PDM) is thereafter inputted in a second pulse counter CNT 2 being a 4-bit counter. This pulse counter CNT 2 is connected to each second block 2, which in turn is connected to a respective one of the display columns $C_0$, $C_1$ . . . $C_N$. The outputted counter value from the second pulse counter CNT 2 is consequently inputted to each second block 2. In this example, the 4-bit pulse counter makes one full count (0-15) per line time, which is due to the fact that the pulse distribution-modulated control signal PDM comprises 16 pulses per line time.

Figures 2, 3, 4:
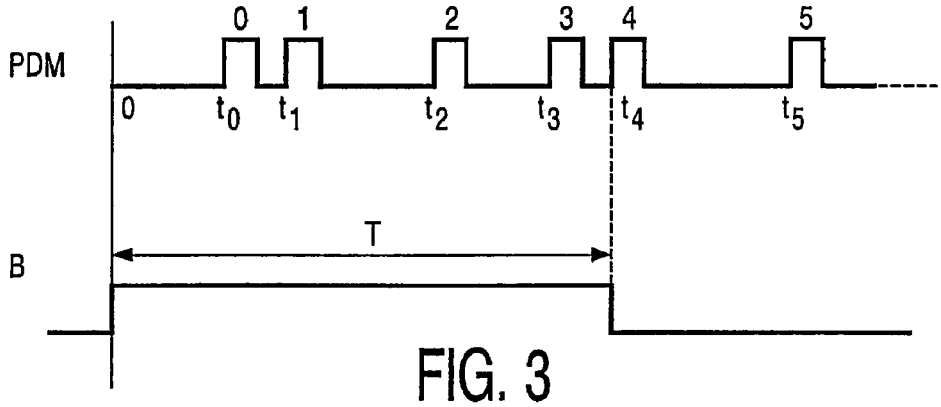
FIG. 2 illustrates a table of grey scale data for use in the circuit of FIG. 1.
FIG. 3 is an example of a timing diagram showing, at A, a part of a pulse distribution-modulated signal and, at B, a resulting drive pulse.
FIG. 4 is a table showing the values of a pulse counter CNT 2, a grey level comparator and a set/reset flip-flop for a selected one of the grey scale data as shown in FIG. 2, for the example shown in FIG. 3.

Each second block 2 further comprises a 4-bit grey level register GLREGO, comprising subsequently the grey levels to be displayed of the pixels in the column to which the second block 2 is connected. For example, this register GLREGO may contain one of the data as shown in FIG. 2, depending on what grey scale is desired for a pixel in a column during a specific line time. This register GLREGO is updated every line via an input connection (D) in a manner known per se. The column GSL in the table in FIG. 2 comprises the possible grey scale values. The column BD in FIG. 2 shows the corresponding binary values as may be present at the output of the grey level register GLREGO.

The output from the grey level register GLREGO is thereafter inputted to a grey level comparator GREYLC, together with the output from the above-described pulse counter CNT 2, both having 4 bits. The output of this comparator is thereafter inputted to a set/reset flip-flop SRFF which is connected to the above-described switch S so as to realize a switching operation between a closed position, in which current is allowed to flow through the column, and an open position, in which the current supply to the column is interrupted.

When comparing the values of the pulse counter CNT 2 and the grey level register GLREGO, a high signal is outputted from the set/reset flip-flop SRFF as long as the value of the grey level register GLREGO exceeds the value of the pulse counter CNT 2, thereby keeping the switch S in a closed position (current flows through display). When the value of the pulse counter exceeds or equals the value of the grey level register GLREGO, the set/reset flip-flop SRFF flips over to a low signal, thereby opening the switch S (no current flowing through display). At the beginning of a new line, the set/reset flip-flop SRFF is set back to the high signal state.

FIGS. 3 and 4 show an example. In this case the desired grey scale is 4, i.e. the value of the grey level register GLREGO is 0100 in accordance with FIG. 2. As can be seen in FIG. 3, the first pulse of the control signal PDM is generated at an instant $t_0$, the next at $t_1$, and so forth in accordance with the values pre-set in the gamma registers GAMMAREG00-GAMMAREG15. The second pulse counter CNT 2 receives the pulses generated at $t_0$, $t_1$, and so forth and adds one to the signal for each pulse received from the first block 1, i.e. outputs 0000 until the instant $t_0$, outputs 0001 until the instant $t_1$, and so forth. The table in FIG. 4 illustrates values, related to the example. Column GLREGO shows the value present in the grey level register GLREGO. Column CNT 2 shows the subsequent values, outputted by the second pulse counter CNT 2. Column GREYLC shows the resulting output of the grey level comparator. Finally column SRFF shows the output of the set-reset flip-flop SRFF. If the output is "1", then the switch S is closed, if the output is "0" then the switch S is open. At the instant $t_4$ the fifth pulse reaches the second counter CNT 2, thereby outputting 0100, which equals the desired grey scale value stored in the grey level register GLREGO. At this instant $t_4$ the output of the grey level comparator GREYLC switches from "1" to "0". As a result the output of the flip-flop SRFF becomes "0" and remains zero until the beginning of the next line. The output of the grey level comparator GREYLC returns to "1", when at the instant $t_5$ the output of the second counter CNT 2 exceeds the grey level value in the grey level register GLREGO. So, at the instant the flip-flop SRFF sends a signal to the switch S so that the drive pulse B to the pixel is ended for the current line. The length T of the drive pulse B is thereby established as $T=t_4$, as can be seen in FIG. 3. The length T may be adjusted by choosing the values stored in the gamma registers GLREGO in a suitable way. Since each line time comprises 256 time slots, this is also the resolution for the length T of the drive pulse B, even if only 4-bit resolution is used in the second block 2.

EXAMPLE

Due to the use of pulse width modulation for controlling grey levels in the prior art, a simple straightforward implementation of gamma correction requires a large memory and a large data transfer for updating the column drivers each line. For typical cellular phone applications, sixteen-level grey scale (i.e. 4 bit) and quadratic gamma correction requires $256=2_8$ clock pulses per line. Addressing 102 parallel column drivers and 65 rows of the display at 60 Hz frame rate requires:

| | |
|---|---|
| MEMORY: | 102 × 65 × 8 bit = 53 kbit |
| DATA RATE: | 60 × 65 × 102 × 8 bit = 3.2 Mbit/s |
| CLOCK FREQUENCY: | 60 × 65 × 256 = 1 MHz |

This memory requires a large chip area, while the high data rate severely loads the bus communication and the high clock frequency increases power dissipation.

However, for a system in accordance with the invention as described above, the requirements are:

| | |
|---|---|
| MEMORY: | 16 × 8 bit + 102 × 65 × 4 bit = 26.6 kbit |
| DATA RATE: | 60 × 65 × 102 × 4 bit = 1.6 Mbit/s |
| CLOCK FREQUENCY: | 60 × 65 × 16 = 62 kHz |

Consequently, in this example of the invention, both the memory chip area and the data rate are halved, while the 16× lower frequency of the control signal PDM ensures a low power dissipation. Due to the fully digital implementation, the system is insensitive to production spreads. Furthermore, fall flexibility may be obtained by utilizing programmable registers in said circuit.

An appropriate initialization of the counters and the set/reset flip-flop is needed, but this may be done in known manner, and will therefore not be described nor shown in the drawings.

Although the above-described implementation of the invention is described with reference to PLED and OLED displays, the invention may be used for gamma correction in other types of displays, having a monotonic relationship, such as an essentially linear, almost linear or non-linear relationship, between the input electric signal and the output luminance signal. An example of such a display is a plasma display.

The invention is primarily intended for application in current-driven systems, but the inventive idea may also be implemented for optimizing voltage-driven output stages.

It should also be noted that the shown embodiment of the invention is only one way of implementing the idea digitally, and many variations of this design can be conceived by a person skilled in the art.

Furthermore, it should be noted that the above-described embodiment of the invention discloses driven display columns, but it is immaterial whether this invention is applied on driven columns or driven rows of the display.

In summary, the invention relates to a display device, preferably an electroluminescent display device, having a monotonic relationship between an input electric signal and an output luminance signal and comprising a matrix of display pixels, each pixel being connected to means for illuminating the pixel with an intensity which is dependent on the width of a drive pulse. The device is characterized in that the width of the drive pulse is controlled by a gamma correction device, in which gamma correction information is supplied in the form of a separate pulse distribution-modulated signal.

The invention also relates to a method of gamma correction in such a display device.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method of gamma correction for use in a display device that includes a matrix of pixels, each pixel being driven by a drive pulse that is pulse width modulated, the method comprising:

generating a pulse distribution-modulated signal, in which the pulse distribution is dependent on pre-determined gamma correction information, deriving a grey level information about each pixel from an input signal, and comparing the grey level information with a counter information based on the pulse distribution-modulated signal, in order to obtain a gamma-corrected width of the drive pulse.

2. The method of claim 1, further including:

generating a pulse count based on the pulse distribution-modulated signal, and comparing the grey level information and the pulse count to provide a comparison output, and controlling the drive pulse to the pixel based on the comparison output.

3. The method of claim 1, wherein generating the pulse distribution-modulated signal includes:

storing timing distribution information values for the pulse distribution-modulated signal, comparing the stored timing distribution information values to a clocked counter value, outputting a signal pulse when each stored timing distribution value equals the clocked counter value, combining the signal pulses to form the pulse distribution modulated signal.

4. The method of claim 3, wherein the stored timing distribution values and the clocked counter value include a larger number of bits than the counter information and the grey level information.

5. A display device, comprising a matrix of display pixels, each pixel being driven by a drive pulse which is pulse width modulated, and a gamma correction device that is configured to control a width of the drive pulse based on a pulse distribution-modulated signal that is dependent on predetermined gamma correction information.

6. The display device of claim 5, wherein the gamma correction device includes a first block that is configured to generate the pulse distribution-modulated signal, and a second block that is configured to receive the pulse distribution-modulated signal and to generate the drive pulse based on the pulse distribution-modulated signal.

7. The display device of claim 6, wherein the first block includes:

a plurality of gamma registers that are configured to store timing distribution information values for the pulse distribution-modulated signal, a plurality of gamma level comparators, each register being connected to a first input of a respective one of the plurality of gamma level comparators, a counter value from a clock counter being arranged to be inputted into a second input of each gamma level comparator, whereby a signal pulse from any one of the gamma level comparators is arranged to be outputted when the value stored in the respective one of the gamma registers equals the inputted clock counter value, and an OR-component that is configured to receive the outputted signal pulses and to provide therefrom the pulse distribution-modulated signal.

8. The display device of claim 6, wherein the second block includes:

a pulse counter that is configured to receive the pulse distribution-modulated signal from the first block, a grey level register that is configured to receive a grey level to be displayed, a grey level comparator that is configured to compare outputs of the pulse counter and the grey level, and a switch that is configured to control the drive pulse based on an output of the grey level comparator.

9. The display device of claim 8, including a set-reset flip-flop that is configured to control the switch based on the output of the grey level comparator, and is configured to be reset each line period.

* * * * *